United States Patent [19]

Breslow et al.

[11] 4,039,184

[45] Aug. 2, 1977

[54] SKILL-TYPE GAME

[75] Inventors: Jeffrey D. Breslow, Highland Park; Alan A. Hicks, Chicago; Harry Disko, South Barrington, all of Ill.

[73] Assignee: Marvin Glass & Associates, Chicago, Ill.

[21] Appl. No.: 652,429

[22] Filed: Jan. 26, 1976

[51] Int. Cl.[2] ..... A63F 9/00

[52] U.S. Cl. ..... 273/1 E; 273/1 M

[58] Field of Search ..... 273/1 R, 1 E, 1 M; 35/22 R, 22 A; 46/235

[56] References Cited

U.S. PATENT DOCUMENTS

| | | | |
|---|---|---|---|
| 1,991,626 | 2/1935 | Rawdon | 273/1 M |
| 2,460,146 | 1/1949 | Prentice | 273/1 E |
| 2,625,396 | 1/1953 | Frechtmann | 273/1 M |
| 3,077,697 | 2/1963 | Fry | 273/1 R X |
| 3,249,357 | 5/1966 | Luchsinger | 273/1 M |
| 3,333,846 | 8/1967 | Glass et al. | 273/1 E |
| 3,488,053 | 1/1970 | Patel | 273/1 E |
| 3,545,750 | 12/1970 | Stachnik | 273/1 E |
| 3,547,436 | 12/1970 | Breslow | 273/1 E |

*Primary Examiner*—William H. Grieb
*Attorney, Agent, or Firm*—Mason, Kolehmainen, Rathburn & Wyss

[57] ABSTRACT

A game of manual skill and amusement having a game board including an elevated plate with one or more openings through which an electrically conductive playing piece, such as a probe, is inserted to retrieve one or more objects from a movably mounted table disposed therebelow without contacting the edge of the opening. The plate includes an upper nonconductive facing board and a conductive backing sheet which extends beyond the facing board at the opening edges to form inwardly projecting flanges of electrically conductive material for possible contact with the probe. Contact of the probe with the conductive edge of an opening completes an electrical circuit to move the lower table and energize a signal device. The lower table is in the form of an electric motor driven turntable which is rotated responsive to a player error by touching the probe with the edge of an opening so that the objects on the turntable are repositioned relative to the openings in the upper plate upon each error by a player. The signal device is an audible signal device and indicates that the player has made an error in play. The objects retrieved from the lower surface also are electrically conductive so that their contact with the opening edge also would indicate an error. The probe can be a magnet secured to one end of an electrically conductive flexible chain which connects at one end with a handle portion for gripping by the player. The objects are of magnetic material.

13 Claims, 7 Drawing Figures

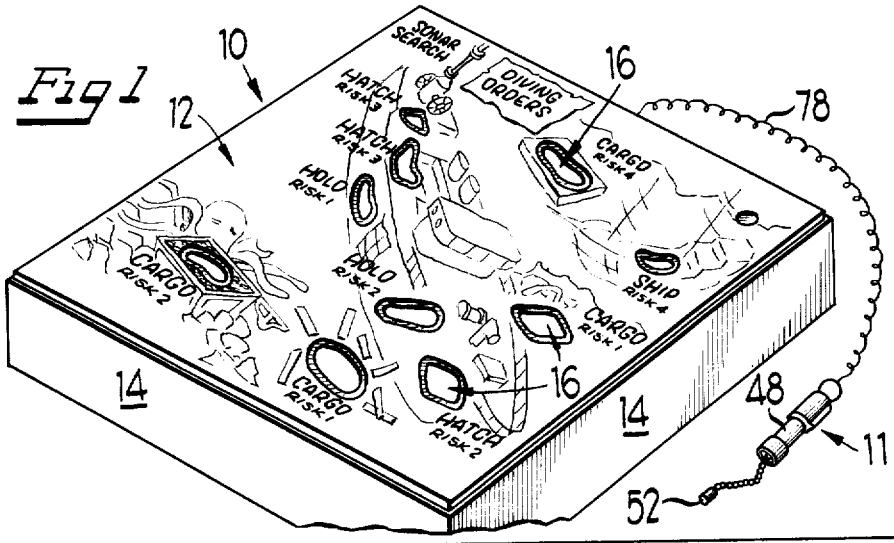
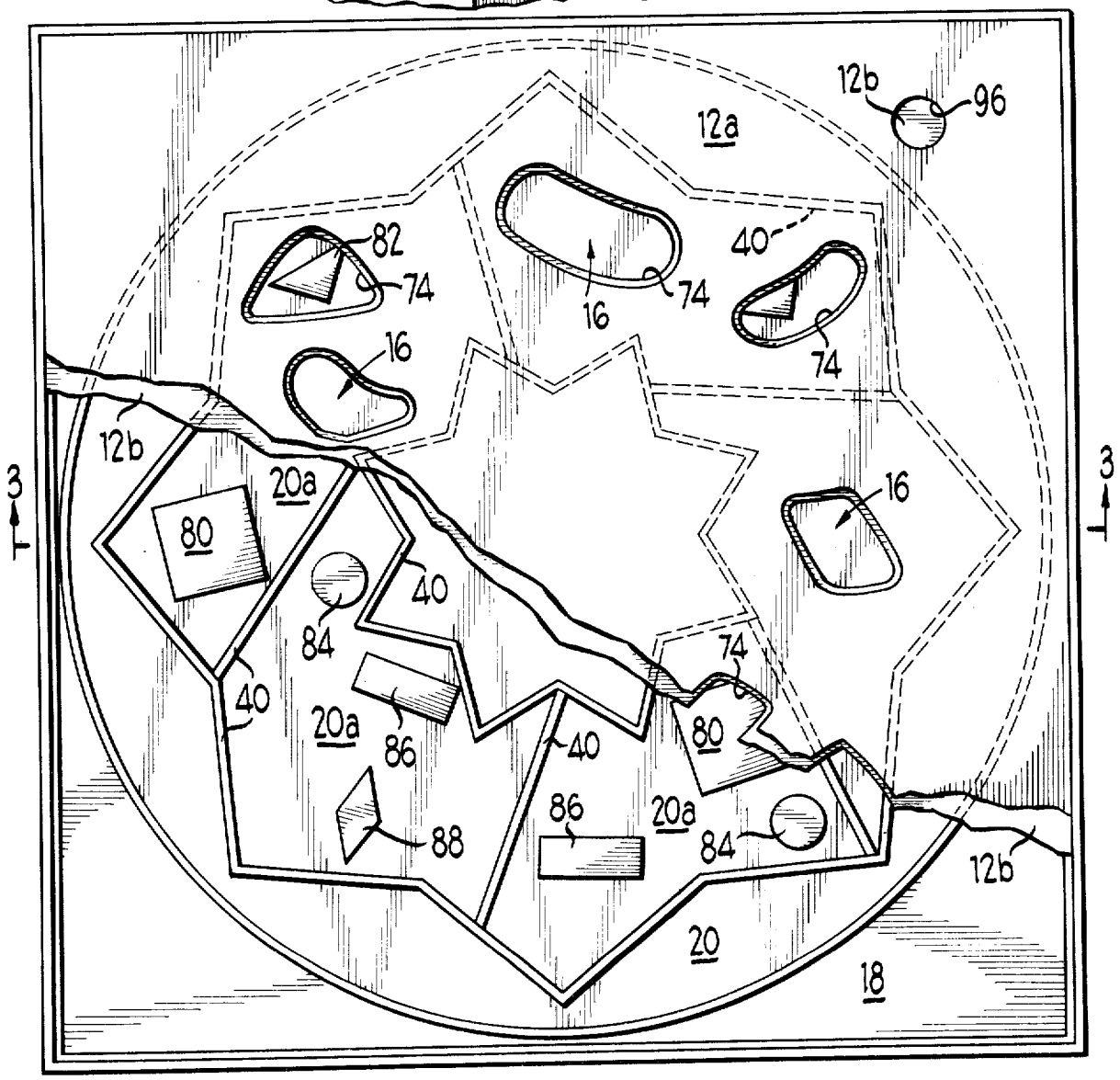
Fig 2

Fig 3
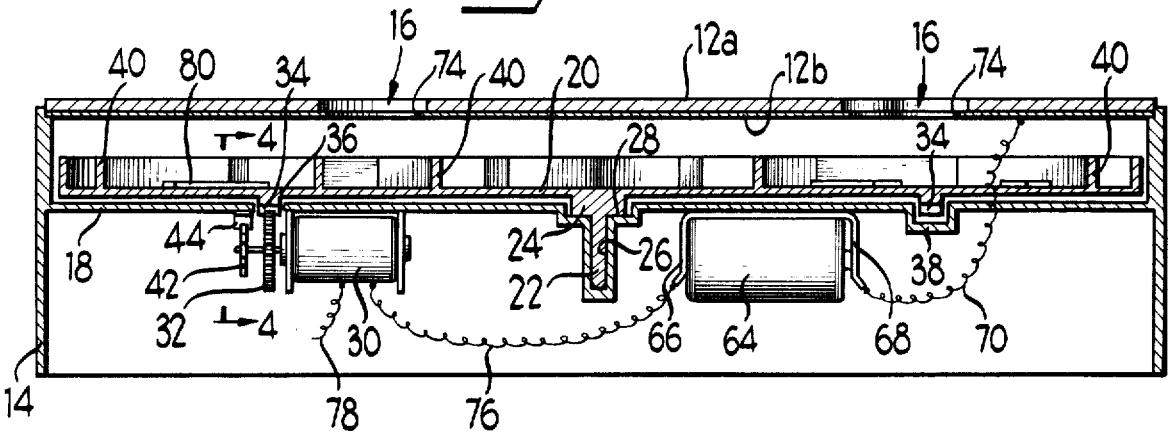
Fig 4
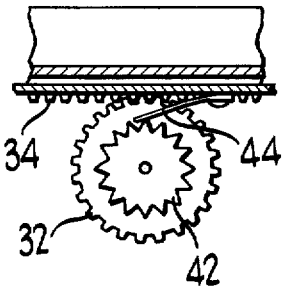
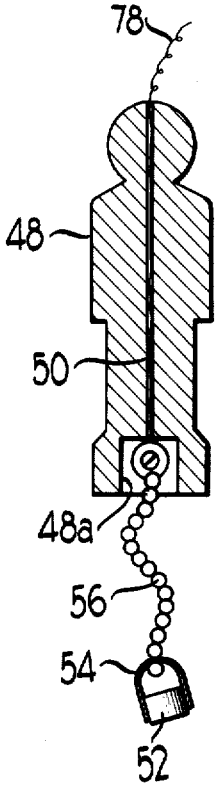
Fig 5
Fig 6
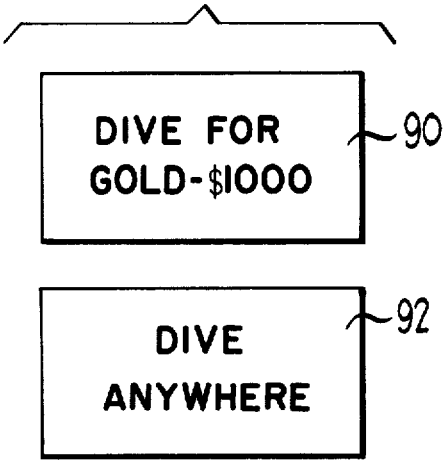
Fig 7
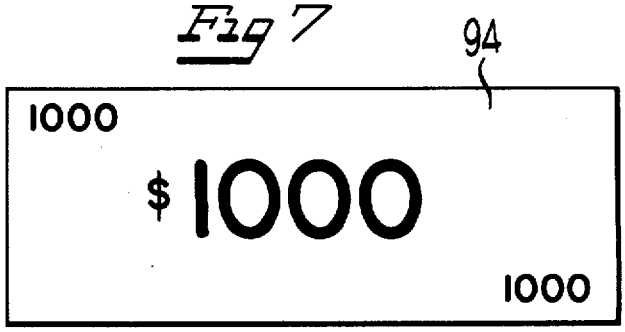

SKILL-TYPE GAME

BACKGROUND OF THE INVENTION

1. Field of the Invention

This invention relates to skill or amusement games of the type where a player retrieves an object through an opening without contacting the edge of the opening with the retrieving device or the object itself.

2. Brief Description of the Prior Art

Games of skill in which a player retrieves an object through an opening and which indicates a playing error, when the object or retrieving device touches the edge of the opening, are known in the art. For example, U. S. Pat. No. 3,333,846 issued Aug. 1, 1967 to the assignee of the present invention, entitled "Game Utilizing Electric Probe", describes a game having an electrically conductive probe for retrieving objects from a support surface parallel to and positioned below the playing surface containing the openings. When the player touches the edge of the opening with the probe, an electrical circuit is completed which actuates a signal device indicating the error. Other patents describing retrieval skill devices are U.S. Pat. No. 2,625,396 issued Jan. 13, 1953 to J. Frechtmann and entitled "Pocket Fishing Game Device"; U.S. Pat. No. 3,488,053 issued Jan. 6, 1970 to N. G. Patel and entitled "Amusement and Dexterity Test Apparatus"; and U.S. Pat. No. 3,547,436 issued Dec. 15, 1970 to Jeffrey D. Breslow, assigned to the assignee of the present invention, and entitled "Electric Pickle Jar Game", each of which deals with a game of manual skill in retrieving an object.

SUMMARY OF THE INVENTION

The present invention provides a new and novel game of skill or amusement in retrieving an object through an opening without touching the opening edges.

In accordance with the present invention, the object to be retrieved is supported on a lower movable support surface or table which is driven by motor means responsive to contact with an opening edge so that after each error the object on the support surface is repositioned relative to the retrieval openings. Playing pieces are used by the player for retrieval purposes through the openings. The playing pieces are electrically conductive, as is the edge of the openings, so that contact of a playing piece with an opening edge completes an electric circuit to actuate the motor and thereby move the table. Preferably, an error signal device also is actuated each time electric contact is made with an opening edge.

While this invention is susceptible of embodiment in many different forms, there is shown in the drawings and will herein be described in detail a specific embodiment and modification thereof, with the understanding that the present disclosure is to be considered as an exemplification of the principles of the invention and is not intended to limit the invention to the embodiment illustrated.

BRIEF DESCRIPTION OF THE DRAWINGS

FIG. 1 is a perspective view of an embodiment of the game of the present invention;

FIG. 2 is an enlarged top plan view of the game board portion of the embodiment of FIG. 1 with a portion of the top wall broken away to show interior structure;

FIG. 3 is a section through the game board shown in FIG. 2, taken generally along line 3—3 of FIG. 2;

FIG. 4 is a fragmentary enlarged sectional view taken generally along line 4—4 of FIG. 3;

FIG. 5 is an enlarged partial sectional view of a probe portion of the embodiment shown in FIG. 1, with the handle portion of the probe in section;

FIG. 6 is a plan view of illustrative playing cards which can be used in playing the embodiment of the game shown in FIG. 1; and FIG. 7 is a plan view of a sample of play money which can be used in playing the embodiment of the game shown in FIG. 1.

DESCRIPTION OF THE REFERRED EMBODIMENT

Referring first to FIGS. 1 through 3, the game device as illustrated includes a game board, generally designated 10, and a playing piece in the form of a probe, generally designated 11. Game board 10 has a top wall in the form of a plate 12 which includes a facing board **12*a* of non-electrically conductive material and a subjacent electrically conductive backing sheet 12*b* (FIGS. 2 and 3). Plate 12 is supported by side walls 14 and has a plurality of openings 16** of different shapes and sizes for retrieval of objects therethrough during play of the game.

As best seen in FIGS. 2 and 3, the game board 10 also has a bridging support wall 18 spaced below and parallel to plate 12. Support wall 18 is secured at its periphery, e.g., by integral molding, to side walls 14.

A movable support platform or table for supporting the retrieval objects is provided in the form of a turntable 20 with a central shaft 22 which includes an enlarged shaft head portion 24. The support wall 18 has a cylindrical shaft receiver 26 which has an annular laterally extending shoulder 28. The receiver 26 receives the turntable shaft 22 with the head portion 24 resting on shoulder 28 to space the turntable 20 above the support wall 18 for free rotation of the turntable.

In order to drive the turntable 20 an electric motor 30 is mounted on the bottom of wall 18 and has a drive gear 32 secured to the motor shaft. Gear 32 is in engagement with and drives a circular or annular rack 34 secured to or integral with the bottom of turntable 20. Opening 36 in wall 18 provides access for such engagement. It is apparent that, when motor 30 is energized, gear 32 will drive rack 34 and rotate turntable 20. Wall 18 also includes an annular trough 38 for accommodating the rack 34 during rotation of the turntable.

Referring again to FIGS. 2 and 3, the plurality of walls 40 upstand from the upper surface of turntable 20 to define individual wall compartments **20*a* on turntable 20**. These compartments receive playing objects to be retrieved, and the walls prevent the objects from sliding from the table or accumulating in a manner which would unbalance the table during rotation.

A single device is providing for signaling errors in play of the game. Accordingly, referring to FIGS. 3 and 4, a ratchet wheel 42 is secured to the shaft of the motor 30 and is driven by motor 30 along with gear 32. A leaf spring 44 is mounted at one end to the bottom of plate 18, with the other end of the spring in the biasing engagement with the teeth of ratchet wheel 42, so that as ratchet wheel 42 is rotated the clicking of the leaf spring 44 against the ratchet wheel teeth produces an audible signal each time motor 30 is energized.

Referring now to FIGS. 1 and 5, probe 11 has a handle portion 48 of electrically insulating material, with an electrically conductive rod 50 extending therethrough.

An electrically conductive magnet 52, secured in an electrically conductive holder 54 by force fit, crimping or the like, is tethered from handle 48. Accordingly holder 54 is secured to one end of an electrically conductive tether chain 56 which is in turn secured at its other end in electrical contact with the lower end of rod 50 within a recess 48*a*. In using the probe for retrieving objects from turntable 20, the tethered magnetic end 52 of the probe is lowered through an opening 16 to contact a playing object so that it can be lifted from the turntable 20.

The electric circuitry includes a power source in the form of a dry cell battery 64 (FIG. 3) suspended from the bottom of wall 18 by suitable spring clips 66 and 68. A conductive wire 70 connects one pole of the battery 64 to backing sheet 12*b* while the other pole is connected by a wire 76 to motor 30 and then through wire 78 to rod 50 of probe 11. It will be seen from FIGS. 2 and 3 that, at an opening 16, the material of sheet 12*b* extends inwardly beyond the non-conductive material of facing board 12*a* to form an inwardly projecting peripheral flange 74 at each opening to assure electrical contact when a playing error is made. Preferably, the retrievable playing objects also are electrically conductive to make errorless retrieval more difficult.

Although many different forms of the game of this invention can be provided and the game may be played by a variety of rules, the game as illustrated is intended for amusement and as a test of skill in removing treasure from a sunken ship and from the area around the ship. Accordingly, the objects (FIG. 2) to be retrieved are in the form of a block of silver 80, an anchor 82, cannon balls 84, blocks of gold 86, and diamonds 88. One or more of each of said objects may be provided, as desired.

In the specific game illustrated, a deck of cards, such as those shown at 90 and 92 (FIG. 6) is provided together with a quantity of play money such as shown at 94 (FIG. 7). A given number of cards are dealt to each player identifying the objects which he is to retrieve and the amount of remuneration to be received for a successful retrieval. The cards may or may not restrict the player as to which opening he is to use to retrieve the object. Note that in FIG. 1 each opening is identified as a cargo opening. or hatch, or the like, and each should be provided with a risk value generally commensurate with the difficulty in retrieving an object through that opening. The risk value is used to adjust the amount of remuneration.

The stack of cards also may include wild cards (not shown) which would permit the player to rotate the turntable until the desired object is positioned beneath an acceptable opening 16. For this purpose, a small opening 96 is provided in facing board 12*a* exposing backing sheet 12*b* so that magnet 52 can be contacted with sheet 12*b* while the objects are observed through an opening 16 until the desired object is properly positioned, at which time the probe 52 is removed from the opening 96.

The foregoing detailed description has been given for clearness of understanding only and no unnecessary limitations should be understood therefrom as some modifications will be obvious to those skilled in the art.

We claim:

1. A game device, comprising: a game board including an elevated plate having a plurality of spaced individual openings each of which has exposed electrically conductive edges, a turntable mounted below said plate, means mounting said turntable in spaced generally parallel relation to said plate for rotation relative thereto, drive means including an electric motor for rotating the turntable, a plurality of playing objects supportable on the turntable and each sized to be retrieved through at least one of said openings, a playing piece in the form of an electrically conductive member for insertion through said openings and having means for retrieval of the objects from said turntable, and electric circuit means completed by electrical contact between said playing piece and said electrically conductive edges for actuating said drive means to rotate said turntable, whereby the objects and the turntable are repositioned relative to the openings.

2. The device of claim 1 including operable means producing a signal responsive to completion of the electric circuit means so that each time contact is made between an electrically conductive edge of one of said openings and said playing piece to complete the circuit and rotate the turntable, the signal means is actuated.

3. The device of claim 2 wherein said signal means produces an audible signal and is driven by said electric motor.

4. The device of claim 2 wherein said signal means comprises a ratchet wheel driven by said electric motor and engaging one leaf spring having its other end secured to suitable frame work.

5. The device of claim 1 wherein said playing piece includes a magnet at one end for retrieving playing objects of magnetic material from said turntable.

6. The device of claim 5 wherein said playing piece includes a flexible electrically conductive tether chain secured to said magnet for manually lowering said magnet through said openings for retrieval of objects from the turntable.

7. The device of claim 1 wherein said playing piece is electrically connected to one lead of the electric motor.

8. The device of claim 1 including upstanding walls on said turntable defining individual compartments for the playing objects.

9. The device of claim 1 wherein said plate comprises a laminate of nonconductive material forming an upwardly facing board having printed thereon matter relating to the game to be played, and a backing consisting essentially of a sheet of conductive material, said conductive sheet extending beyond the nonconductive facing board at each of said openings to define said edges so that when the probe is inserted into an opening in a manner whereby it comes into contact with the edge of the opening electrical contact is made between the playing piece and the sheet of conductive material to complete said electric circuit means.

10. The device of claim 1 wherein said openings and said playing objects are of varying sizes so as to vary the success opportunity of retrieving a particular object through a particular opening in relation to the rotational position of said turntable.

11. A game, comprising: a game board including an elevated plate having at least one individual opening, said opening having electrically conductive material at its periphery, a subjacent table having a support surface, a playing object supportable on said support surface and sized to be retrievable through said opening, drive means for moving said table relative to said plate to vary the position of said playing object, a playing piece in the form of an electrically conductive member for insertion through said opening and having means for retrieval of the playing object from said table, and electric circuit means responsive to electrical contact between said playing piece and said electrically conductive material for actuating said drive means to move said table with respect to said game board.

12. A game, comprising: a game board including an elevated plate having a plurality of spaced individual openings, said openings each having electrically conductive material at their periphery, a subjacent turntable having a support surface, a plurality of playing objects supportable on said support surface and each playing object being sized to be retrievable through at least one of said openings, means mounting said turntable in spaced relation to said game board for rotation relative thereto and in a position for retrieval of the objects through the openings in the plate, drive means including an electric motor for rotating the turntable, a freely movable, hand held playing piece in the form of an electrically conductive member for insertion through the openings in said board and having means for retrieval of objects from said turntable through said openings, and signal means for providing an output signal responsive to electrical contact between said playing piece and said electrically conductive material for actuating said signal means.

13. The device of claim 12 wherein said openings and said playing objects are of varying sizes so as to vary the success opportunity of retrieving a particular object through a particular opening in relation to the rotational position of said turntable.

* * * * *